US006265366B1

(12) United States Patent
Bonett

(10) Patent No.: US 6,265,366 B1
(45) Date of Patent: Jul. 24, 2001

(54) PROCESS FOR BLEACHING SURFACES

(75) Inventor: Heather Elizabeth Bonett, Hull (GB)

(73) Assignee: Reckitt Benckiser (UK) Limited, Slough (GB)

( * ) Notice: Subject to any disclaimer, the term of this patent is extended or adjusted under 35 U.S.C. 154(b) by 0 days.

(21) Appl. No.: 09/040,115

(22) Filed: Mar. 17, 1998

Related U.S. Application Data

(62) Division of application No. 08/595,358, filed on Feb. 1, 1996, now Pat. No. 5,744,439.

(30) Foreign Application Priority Data

Feb. 1, 1995 (GB) ..... 9501922

(51) Int. Cl.[7] ..... C11D 7/08; C11D 7/18; C11D 7/38; C11D 7/54

(52) U.S. Cl. ..... 510/238; 510/367; 510/372; 510/375; 510/405; 252/186.41; 252/186.42

(58) Field of Search ..... 510/238, 367, 510/372, 375, 405; 252/186.41, 186.42

(56) References Cited

U.S. PATENT DOCUMENTS

| | | | |
|---|---|---|---|
| 3,708,431 | 1/1973 | Prussin | 510/372 |
| 3,801,512 | 4/1974 | Solenberger | 510/372 |
| 3,819,524 | 6/1974 | Schubert et al. | 510/372 |
| 4,101,440 | 7/1978 | Akagi et al. | 510/372 |
| 4,806,169 | 2/1989 | Spane et al. | 510/247 |
| 4,857,225 | 8/1989 | Terada et al. | 510/372 |
| 4,885,106 | 12/1989 | Lapham et al. | 510/372 |
| 5,451,346 | 9/1995 | Anou | 510/372 |
| 5,545,343 | 8/1996 | Brougham et al. | 510/372 |

FOREIGN PATENT DOCUMENTS

| | | | |
|---|---|---|---|
| 3-140400 | * | 6/1991 | (JP) . |
| WO 93/02973 | | 2/1993 | (WO) . |

OTHER PUBLICATIONS

Derwent Abstracts Nos. JP 55–109498; JP 59–164400; JP 1–240600; JP 3–140400; JP 4–59900; JP 5–156293; and JP 6–192692.

Copy of International Search Report for Int'l Appln. No. PCT/GB96/00054 dated Dec. 6, 1996.

* cited by examiner

*Primary Examiner*—Jacqueline V. Howard
*Assistant Examiner*—Cephia D. Toomer
(74) *Attorney, Agent, or Firm*—Fish & Richardson P.C.

(57) ABSTRACT

A process for bleaching a surface, by applying to that surface an aqueous composition having a pH of 2 or less and comprises a mixture of (a) an aqueous composition comprising hydrogen peroxide or an organic peracid having a pH of greater than 2 but less than 7 and (b) an acidic composition wherein components (a) and (b) are mixed not more than two hours before being applied to the surface requiring bleaching. The organic acid of component (a) has the formula XC(O)OOH where X is hydrogen or $CH_3(CH_2)_n$ and n is 0 to 8. The acid composition (b) comprises hydrochloric, sulphamic, tartaric, phosphoric, oxalic, citric, salicylic or ascorbic acids.

9 Claims, No Drawings

PROCESS FOR BLEACHING SURFACES

This application is a division of Ser. No. 08/595,358 filed Feb. 1, 1996, U.S. Pat. No. 5,744,439.

FIELD OF THE INVENTION

The present invention relates to an improved process for carrying out bleaching and/or limescale removal at a surface.

BACKGROUND OF THE INVENTION

The use of oxygen bleaches in compositions for bleaching household surfaces has been known for a long time and many such compositions are available. However a common difficulty in formulating such a composition is to ensure that it remains stable during storage but is sufficiently active on use. This is particularly difficult to achieve in liquid bleaching compositions. Many solutions have been proposed to this problem but most of these require the use of expensive stabilizing components or of complex formulation processes.

One solution has been to formulate liquid peroxygen bleaches at pHs between about 3 and 7 to produce a stable composition, but in practice such compositions do not provide sufficient bleaching power to be useful for many household situations. Attempts have therefore also been made to formulate liquid peroxygen bleach compositions at pHs above this range to improve the bleaching power. However these generally require expensive stabilizing compounds to prevent loss of activity after manufacturing.

The present invention provides a peroxide bleach product which has acceptable stability after manufacture, but which is capable of providing effective bleaching power when used by the consumer.

Commercial products capable of removing limescale from domestic surfaces are well known. Most of these products are based on acids which simply dissolve the limescale. Many surfaces require both limescale removal and bleaching, but no commercially available products are truly capable of both functions.

Furthermore, it would be convenient to the consumer to purchase one product which could be used either for limescale removal or bleaching as required, even when both functions are not required simultaneously.

The present invention provides a product which is capable of carrying out effective bleaching and/or limescale removal at a surface.

SUMMARY AND DETAILED DISCLOSURE OF THE INVENTION

According to the invention, there is provided a process for bleaching and/or providing limescale removal at a surface, comprising applying to that surface an aqueous composition of hydrogen peroxide or an organic peracid, which composition has a pH of 2 or less and comprises a mixture of: a) an aqueous composition comprising hydrogen peroxide or an organic peracid having a pH of greater than 2 but less than 7 (hereinafter component (a)), and b) an acidic composition (hereinafter component (b)), wherein components (a) and (b) are mixed not more than two hours before being applied to the surface requiring bleaching and/or limescale removal.

Compositions suitable for carrying out the invention may be provided in ready-to-use form or, preferably, may be provided as separate components suitable for mixing by the consumer. Where the compositions are suitable for mixing they may be mixed either directly at the surface or remote from the surface before application.

According to a further aspect of the invention, there is provided a process for preparing an aqueous bleaching and/or limescale removing composition having a pH of 2 or less by mixing a) an aqueous composition comprising hydrogen peroxide or an organic peracid having a pH of greater than 2 but less than 7 (hereinafter component (a)), and b) an acidic composition (hereinafter component (b)), wherein components (a) and (b) are mixed not more than two hours before being applied to the surface requiring bleaching and/or limescale removal.

The organic peracids are preferably compounds of the formula

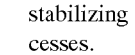

$$XC(O)OOH$$

wherein X is H or $CH_3(CH_2)_n$ and n is an integer from 0 to 8, most preferably peracetic acid (n=0), peroxypropionic acid (n=1) or peroxyhexanoic acid (n=4).

By "acidic composition" is meant a composition comprising at least one acid (in liquid or solid form), such that when mixed in suitable proportions with the aqueous composition comprising hydrogen peroxide or an organic peracid the resultant mixture has a pH of 2 or less.

Component (a) preferably comprises hydrogen peroxide or peracetic acid.

Component (b) may be a solid (i.e. granular or powder) acidic composition or, preferably, an aqueous liquid acidic composition.

Where component (b) is an aqueous liquid, it preferably comprises hydrochloric acid, sulphamic acid, tartaric acid, phosphoric acid, oxalic acid, citric acid or salicylic acid; most preferably hydrochloric acid, sulphamic acid, phosphoric acid or citric acid.

Where component (b) is solid, it preferably comprises tartaric acid, phosphoric acid, ascorbic acid, oxalic acid, citric acid or salicylic acid; most preferably phosphoric acid or citric acid.

In accordance with the invention, the two components (a) and (b) may be mixed in any suitable proportions, depending upon their initial concentrations, suitably such that the finally applied mixture comprises 0.01–30% w/w of hydrogen peroxide or an organic peracid. Preferably, the ratio of component (a) to component (b) is from 10:1 to 1:10 most referably from 2:1 to 1:2.

It is preferred that the two components (a) and (b) are mixed no more than 10 minutes before application to the surface requiring bleaching and/or limescale removal.

It is most preferred that the two components (a) and (b) are mixed at the surface requiring bleaching and/or limescale removal, so that the improved bleaching effect may occur immediately.

In this aspect component (a) may be applied to the surface followed by component (b) or vice versa. Alternatively (and preferably) components (a) and (b) are applied to the surface requiring bleaching and/or limescale removal substantially simultaneously.

According to a preferred embodiment of the present invention, the concentration of hydrogen peroxide or organic peracid in the composition immediately after mixing is from 0.01 to 10% w/w. This would mean for example in a 1:1 mix of component (a) to (b) that component (a) prior to the mixing would contain from 0.02 to 20% w/w of hydrogen peroxide or an organic peracid. Where component (a) comprises hydrogen peroxide it is most preferred that the concentration of hydrogen peroxide in the mixture immediately after mixing should be from 1.5 to 5% w/w. For example, if a 1:1 mixture of components (a) and (b) is to be mixed, then component (a) 15 should comprise from 3 to 10% w/w hydrogen peroxide.

The concentration of the acid in component (b) should be chosen such that the pH of the mixture of components (a) and (b) will be 2 or less. Accordingly this will depend upon the acid chosen, the proportion of components (a) and (b) to be mixed, the initial pH of the component (a), and the intended pH of the mixture of components (a) and (b).

The process of the present invention alleviates the need to use further stabilizing components when preparing commercial products.

The compositions suitable for use in the process according to the invention may further include any other conventional additives known to the art. Examples of these include fragrances, surfactants (for example anionic, cationic, nonionic, amphoteric or mixtures thereof), thickeners, dyes, sequesterants, chelating agents, germicides, preservatives, corrosion inhibitors or antioxidants. Most referably the compositions suitable for carrying out the present invention will contain at least one of the following:

- an anionic surfactant (e.g. sodium xylene sulphonate),
- a nonionic surfactant (e.g. an alkyl alcohol ethoxylate),
- a cationic surfactant (e.g. a quaternary ammonium surfactant),
- a thickener (e.g. xanthan gum),
- a dye,
- a fragrance.

The above auxiliary components may be included in the compositions suitable for use in the process of the present invention at concentrations of from 0.01% w/w to 10% w/w. These auxiliary ingredients may be included in either component (a) or component (b) or both if appropriate.

According to a further aspect of the present invention, there is provided the use of an aqueous composition of hydrogen peroxide or an organic peracid, which composition has a pH of 2 or less, to remove limescale at a surface or to both bleach and remove limescale at a surface.

Compositions suitable for use in the process according to the present invention may be stored in any appropriate containers known to the art. For example, the two components may be stored in a kit comprising a separate dispenser for each component or in a single two-compartment pack suitable for sequential or simultaneous dispensing.

Where both components (a) and (b) are liquids, most preferably they may be stored in a two-compartment dispenser, one compartment containing each component and the dispenser being adapted to dispense each component onto a surface, either sequentially or, preferably, simultaneously.

According to a further aspect of the invention, there is provided a two-compartment dispenser comprising: a first compartment containing an aqueous composition comprising hydrogen peroxide or an organic peracid and having a pH of greater than 2 but less than 7; a second compartment containing an acidic component; and dispensing means adapted to dispense the contents (or a part thereof) of the compartments onto a surface either sequentially or simultaneously to form a mixture thereof, whereby the pH of the acidic component is so selected, and/or the dispensing means is so adapted, that the mixture has a pH of less than 2.

Preferably, the first compartment contains an aqueous composition comprising 3 to 10% w/w hydrogen peroxide; and the second compartment contains an aqueous composition comprising hydrochloric acid.

A process according to the present invention may be used to bleach and/or remove limescale from any suitable acid-resistant household surface, for example ceramic surfaces such as lavatory surfaces or tiles.

The invention will now be illustrated by the following Examples.

EXAMPLES

Example 1

The following two aqueous compositions are prepared.

| | |
|---|---|
| Composition (a) | |
| Hydrogen peroxide (35% aqueous solution) | 9 g |
| Water | 91 g |
| Composition (b) | |
| Hydrochloric acid (36 Twaddle) | 25 g |
| Water | 75 g |

The two compositions (a) and (b) are mixed together in a beaker and the resulting composition has a pH of approximately 0.

Samples of the composition are immediately applied to surfaces requiring bleaching, and left in contact for 20 minutes. The surfaces are then rinsed with water. The mixed composition produces improved bleaching of the surface compared to either composition (a) or (b) alone when diluted with an equal volume of water.

Example 2

The following compositions are prepared.

| | parts w/w |
|---|---|
| Composition (a) | |
| Hydrogen peroxide (35% aqueous solution) | 9.00 |
| Sodium xylene sulphonate (30%) | 2.40 |
| Hexadecyl trimethylammonium chloride (30%) | 3.77 |
| Citric acid | 0.31 |
| Fragrance | 0.20 |
| Dye | 0.005 |

-continued

| | parts w/w |
|---|---|
| Water | 84.315 |
| pH 2.6 | |
| Composition (b) | |
| Hydrochloric acid (36 Twaddle) | 25.00 |
| Tallow trimethyl ammonium chloride (50% in IPA/water) | 0.60 |
| Tallow bis (2-hydroxyethyl) amine | 1.20 |
| Fatty (C12/C14) alcohol ethoxylate (12 mole) | 0.27 |
| Water | 72.93 |

Equal proportions of the mixed to give a composition having peroxide concentration of 1.55% and an initial pH of approximately 0.

Example 3

The following compositions are prepared

| | Parts w/w |
|---|---|
| Composition (a) | |
| Hydrogen Peroxide (35% aqueous solution) | 9.00 |
| Surfactants- | |
| Arquad 16/29 (AKZO) | 3.77 |
| Sodium Xylene Sulphonate (30%) | 2.40 |
| Citric Acid (Anhydrous) | 0.31 |
| Fragrance (Parfex 43174 (Givaudan Roure)) | 0.20 |
| Dye (Sandolun Turquoise EVS (Sandoz dyes)) | 0.006 |
| Water | 84.31 |
| Composition (b) | |
| Pre-mix | |
| Soft Water | 83.83 |
| Surfactants- | |
| Arquad T-50 | 3.86 |
| Ethomeen T12 | 8.00 |
| Lutensol (80%) | 1.78 |
| Dye (Flexonyl B2G (Hoechst)) | 0.0253 |
| Main Mix | |
| Hydrochloric Acid (36 Twaddle) | 25.00 |
| Pre-mix | 15.00 |
| Soft Water | 60.00 |

Equal proportions of the two compositions (a) and (b) are mixed to give a composition having an initial hydrogen peroxide concentration of 1.575% and an initial pH of less than 1.

Example 4

The improved bleaching performance of the compositions of the invention is tested by the following procedure.

Three ceramic tiles are covered in blue absorbent laboratory paper (Kimberly-Clark). Three ml of one of the following compositions are applied to the tiles.

i) Example 1, Composition (a), diluted to 50% w/w with water (1.575% w/w hydrogen peroxide);

ii) Example 1, Composition (b), diluted to 50% w/w with water (4.5% w/w active hydrochloric acid);

iii) Example 1, a 1:1 mixture of Composition (a) and Composition (b) (1.575% w/w hydrogen peroxide and 4.5% active hydrochloric acid).

The tiles are photographed every hour to record any bleaching of the paper. Composition iii) (the mixture of Compositions (a) and (b)) demonstrates good bleaching with compositions i) and ii) showing very little or no bleaching.

Example 5

The improved limescale dissolving performance of compositions of the invention is tested by the following procedure.

Pre-weighed 1 inch marble cubes are placed into 150 ml samples of the three compositions i), ii) and iii) described in Example 4. The cubes are removed from the compositions after five minutes, washed, dried, weighed and replaced into the original compositions. This process is repeated after 30, 60 and 120 minutes. The average (over 3 repetitions) weight loss in each composition is:

| | Average % Weight Loss | | | | |
|---|---|---|---|---|---|
| Composition | 0 mins | 5 mins | 30 mins | 60 mins | 120 mins |
| i) | 0.0 | 0.013 | 0.013 | 0.043 | 0.06 |
| ii) | 0.0 | 8.09 | 29.95 | 38.74 | 41.29 |
| iii) | 0.0 | 10.4 | 33.13 | 47.04 | 50.55 |

The invention has been described in detail with particular reference to preferred embodiments thereof, but it will be understood that variations and modifications can be effected within the spirit and scope of the invention.

What is claimed is:

1. A process for bleaching a surface, comprising applying to that surface an aqueous composition having a pH of 2 or less and comprising a mixture of (a) an aqueous composition comprising hydrogen peroxide or an organic peracid having a pH of greater than 2 but less than 7, and (b) an acidic composition comprising an acid selected from the group consisting of hydrochloric acid, sulphamic acid, tartaric acid, phosphoric acid, oxalic acid, citric acid and salicylic acid wherein the components (a) and (b) are mixed not more than two hours before being applied to the surface requiring bleaching.

2. A process according to claim 1, wherein components (a) and (b) are mixed on the surface requiring bleaching.

3. A process according to claim 1, wherein component (a) is hydrogen peroxide or a peracid of the formula $$XC(O)OOH$$

in which X is hydrogen or $CH_3(CH_2)_n$ and n is an integer from 0 to 8.

4. A process according to claim 3, wherein component (a) is hydrogen peroxide or peracetic acid.

5. A process according to claim 1, wherein the concentration of hydrogen peroxide or organic peracid in the composition after mixing is from 0.01 to 10% w/w.

6. A process for preparing an aqueous bleaching composition having a pH of 2 or less by mixing, not more than two hours prior to the intended use of said composition for bleaching, (a) an aqueous composition comprising hydrogen peroxide or an organic peracid having a pH of greater than 2 but less than 7, and (b) an acidic composition comprising an acid selected from the group consisting of hydrochloric acid, sulphamic acid, tartaric acid, phosphoric acid, oxalic acid, citric acid, salicylic and ascorbic acid.

7. A process according to claim 6, wherein component (a) is hydrogen peroxide or a peracid of the formula $$XC(O)OOH$$

in which X is hydrogen or $CH_3(CH_2)_n$ and n is an integer from 0 to 8.

8. A process according to claim 7, wherein component (a) is hydrogen peroxide or peracetic acid.

9. A process according to claim 8, wherein the concentration of hydrogen peroxide or organic peracid in the composition after mixing is from 0.01 to 10% w/w.

* * * * *